US005301876A

United States Patent [19]

Swank et al.

[11] Patent Number: 5,301,876

[45] Date of Patent: Apr. 12, 1994

[54] UNIT INJECTOR WITH INTERCHANGEABLE SUBASSEMBLY FOR CONVERTING FROM OPEN NOZZLE TO CLOSED NOZZLE OPERATION

[75] Inventors: Bryan W. Swank; Laszlo Tikk; Yul J. Tarr, all of Columbus, Ind.

[73] Assignee: Cummins Engine Company, Inc., Columbus, Ind.

[21] Appl. No.: 971,232

[22] Filed: Nov. 4, 1992

Related U.S. Application Data

[63] Continuation-in-part of Ser. No. 729,500, Jul. 12, 1991, Pat. No. 5,209,403.

[51] Int. Cl.[5] ..... F02M 61/20

[52] U.S. Cl. ..... 239/95; 239/289; 239/390

[58] Field of Search ..... 239/88, 91, 95, 289, 239/390, 391

[56] References Cited

U.S. PATENT DOCUMENTS 4,134,549 1/1979 Perr .
4,249,499 2/1981 Perr .
4,410,137 10/1983 Perr .
4,410,138 10/1983 Peters et al. .
4,419,977 12/1983 Hillebrand .
4,420,116 12/1983 Warlick .
4,463,901 8/1984 Perr et al. .
4,721,247 1/1988 Perr .
4,986,472 1/1991 Warlick et al. .
5,033,442 7/1991 Perr et al. .
5,076,240 12/1991 Perr .
5,094,397 3/1992 Peters et al. ..... 239/91

*Primary Examiner*—Andres Kashnikow
*Assistant Examiner*—William Grant
*Attorney, Agent, or Firm*—Sixbey, Friedman, Leedom & Ferguson

[57] ABSTRACT

A fuel injector which uses interchangeable subassemblies to allow the fuel injector to be converted from open to closed nozzle options without affecting engine installation, and without altering the timing or metering principles. In accordance with a preferred embodiment of the invention, the fuel injector is comprised of two subassemblies, a first subassembly of which is a timing or control subassembly that is used in both the closed and open nozzle options, and which forms the top portion of the fuel injector. The second subassembly is a nozzle assembly and is form in two versions, an open nozzle version and a closed nozzle version, either of which can be used with the timing assembly. In a preferred form of the timing subassembly, a pressure-responsive valve for opening a timing chamber draining passage is provided within the upper plunger.

19 Claims, 6 Drawing Sheets

UNIT INJECTOR WITH INTERCHANGEABLE SUBASSEMBLY FOR CONVERTING FROM OPEN NOZZLE TO CLOSED NOZZLE OPERATION

CROSS REFERENCE TO RELATED APPLICATION

This application is a continuation-in-part of commonly owned, copending U.S. patent application Ser. No. 07/729,500, filed Jul. 12, 1991 by two of the present inventors, now U.S. Pat. No. 5,209,403.

BACKGROUND OF THE INVENTION

1. Field of the Invention

The present invention relates to fuel injectors and in particular to unit fuel injectors for cyclically injecting fuel into an internal combustion engine in variable amounts and with varying timing.

2. Description of Related Art

Unit fuel injectors generally fall into two categories. That is, there are open nozzle injectors of the type represented by Perr U.S. Pat. No. 4,721,247 and there are closed nozzle injectors of the type represented by U.S. Pat. No. 4,463,901. Open and closed nozzle injectors have different injection characteristics, and neither type can be said to be better than the other for all possible engine applications. Thus, it can be necessary for an engine or motor vehicle manufacturer to keep both types of fuel injection systems available for installation on any given engine depending solely on the particular application for which the engine will be used.

However, to develop and produce two separate fuel injection systems, knowing only one will be used, not only increases the initial investment which must be made, but also increases later piece prices, inventory and service costs. These cost factors offset any benefits that might be associated with the fact that an injector which is specifically designed to be only a closed nozzle injector or only an open nozzle injector might be able to achieve a more optimized design than a multipurpose one, e.g., a design that might be smaller, simpler, etc.

In above noted U.S. Pat. No. 5,209,403, it was first disclosed how it could be possible to construct a unit fuel injector on a modular basis so that an upper control subassembly could be interchangeably used with either an open nozzle type or closed nozzle type injector nozzle subassembly. More specifically, this capability is attained by locating the timing chamber relief valve structure wholly in the upper part of the injector above the lower, injection plunger. However, in that case, conventional injector nozzle structure was merely adapted for use with the control subassembly, as opposed to the injector, as a whole, being designed for the specific purpose of providing a unit fuel injector system having interchangeable open and closed nozzle type injector nozzle subassemblies. Thus, the design of this earlier application does not allow the fuel injector to be converted from open to closed nozzle options without affecting engine installation, and without having to accept any performance or cost compromises relative to a fuel injector which is specifically designed to be only either a closed nozzle injector or an open nozzle injector.

U.S. Pat. No. 5,209,403 also dealt with the inability of prior relief valves, such as that in the above-mentioned Perr patent, as well as that in Warlick et al. U.S. Pat. No. 4,986,472, to alter the opening stroke of the relief valve in order to control more precisely the draining of timing fluid from the timing chamber. More specifically, the parent application provides a timing chamber relief structure which enables the opening stroke of the relief valve to be adjusted so that the timing chamber draining rate can be precisely controlled independently of spring pressure. However, not taken into consideration was the fact that, on the one hand, insufficient spring pressure can lead to chattering of the valve element while, on the other hand, high valve spring loading of the valve element can lead to excessive "droop" values (i.e., the difference between the injection pressures produced by the relief valve under low speed engine operating conditions and the injection pressures produced by the relief valve under high speed engine operating conditions), meaning that either excessive high speed or insufficient low speed pressures result.

SUMMARY OF THE INVENTION

In view of the foregoing, it is a general object of the present invention to provide a unit fuel injector system which can be operated as either a closed nozzle type fuel injector or as an open nozzle type fuel injector without having to develop and produce two separate fuel injection systems.

In accordance with the preceding object, it is a more specific object of the present invention to provide a fuel injector which uses interchangeable subassemblies to allow the fuel injector to be converted from open to closed nozzle options without affecting engine installation, and without altering the timing or metering principles.

It is also an object to optimize the fuel injector designs in a way which enables the foregoing objects to be achieved without having to accept any performance or cost compromises relative to a fuel injector which is specifically designed to be only either a closed nozzle injector or an open nozzle injector.

Yet another object in accordance with the present invention is to provide a timing chamber relief valve structure which enables the opening stroke thereof to be adjusted independently of the spring load on the valve closure element without leading to either chattering of the valve element or excessive injection pressure droop.

These objects are achieved in accordance with a preferred embodiment of the invention by designing the fuel injector so as to be comprised of two subassemblies. The first subassembly is a control subassembly that is used in both the closed and open nozzle options, and which always forms the top portion of the fuel injector (although the camshaft of the drive train which operates the injector will differ in that, as usual, different appropriately configured camshafts are used with closed nozzle and open nozzle fuel injectors). The second subassembly is a nozzle subassembly and is formed in at least two versions, an open and a closed nozzle version, either of which can be used with the control subassembly without any modifications being required and without affecting engine installation since the external envelope and metering control principles are the same whether the open nozzle type injector nozzle subassembly type or the closed nozzle type injector nozzle subassembly is mounted to the control subassembly.

In one specific form, the invention starts with an open nozzle injector as shown and described in the above-noted parent application, and with only minimal compromises being required (beyond the basic fact that the drillings within the closed nozzle injector nozzle subassembly had to be standardized relative to those of the open nozzle version, so that a more complex arrangement of drillings than was previously required for the closed nozzle fuel injector nozzle subassembly became necessary), by simply making the lower half of the open nozzle injector version, i.e., the open nozzle subassembly, somewhat longer than it might otherwise have been, virtually without any other changes in structure or operation being required, it was matched exteriorly to the exterior of the closed nozzle subassembly. With both nozzles presenting the same external envelope, engine installation became unaffected by the injector nozzle subassembly selection, since the common upper control assembly insures that the metering control principles are the same.

Furthermore, in this version, the above-noted problems of valve chattering and injection pressure droop are avoided by providing a low mass valve element and a valve spring having a spring rate coordinated thereto so as to obtain a natural frequency of the valve element that is high enough to prevent it from chattering and a valve droop value which insures sufficient injection pressures under low speed engine operating conditions while avoiding excessive injection pressures under high speed engine operating conditions.

However, in a second form of the invention, specifically designed to achieve an interchangeable design, it was discovered, surprisingly, that optimized designs for the subassemblies could be achieved that imposed no compromises. That is, the interchangeable design contained no characteristics that would be changed, either to improve performance or to reduce costs, if the injector were to be produced exclusively as a closed nozzle injector or only as an open nozzle injector. Put another way, achieving of an interchangeable open/closed nozzle fuel injector design where a maximum number of parts are common to both versions was found not to be incompatible with the achieving of maximum performance and cost minimization.

These and other objects, features and advantages of the present invention will be apparent from the following detailed description when viewed in conjunction with the accompanying drawings which show preferred embodiments of the invention.

DETAILED DESCRIPTION OF THE PREFERRED EMBODIMENTS

Figure 4:
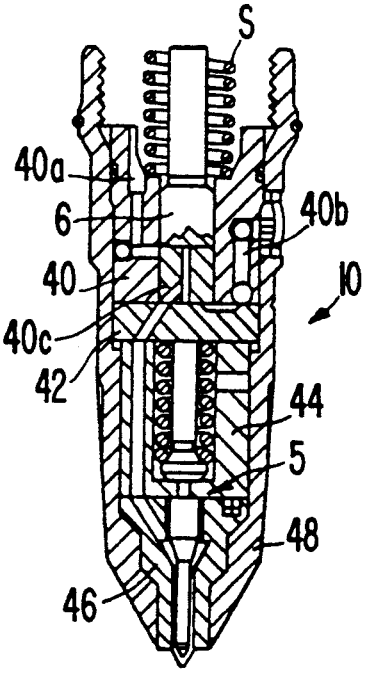
FIG. 4 is a cross-sectional view of a nozzle subassembly of the closed nozzle type for use with the control subassembly of FIG. 3 in the fuel injector of FIG. 1.
Figure 5:
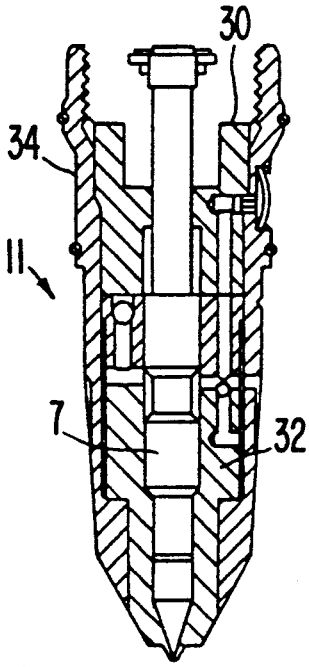
FIG. 5 is a cross-sectional view of a nozzle subassembly of the open nozzle type for use with the control subassembly of FIG. 3 in the fuel injector of FIG. 2.

Injectors 1 and 2 were developed, initially, to demonstrate the practicality of the interchangeable injector system concept, using known injector technology rather than specifically designing new injector technology specially suited for a "commonized" open/closed nozzle injector approach knowing that compromises would undoubtably have to be accepted to achieve a fusion of two different types of injector designs. Since the most pronounced differences in structure between open and closed nozzle injectors exist in the lower, nozzle portion of the injector (as reflected by their names, a closed nozzle injector has a nozzle valve assembly 5 that has no counterpart in an open nozzle injector, bringing about associated differences in their lower, metering and injection plungers 6, 7 and the corresponding metering and injection chambers in which they act), these portions were made into separate subassemblies 10, 11 (FIGS. 4, 5, respectively).

Figure 1:
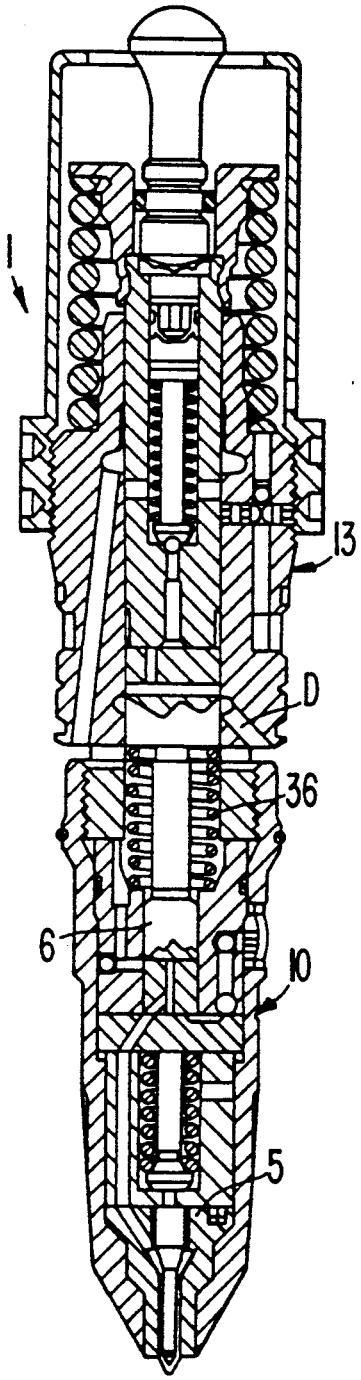
FIG. 1 is a cross-sectional view of a closed nozzle fuel injector in accordance with a first embodiment of the invention.
Figure 2:
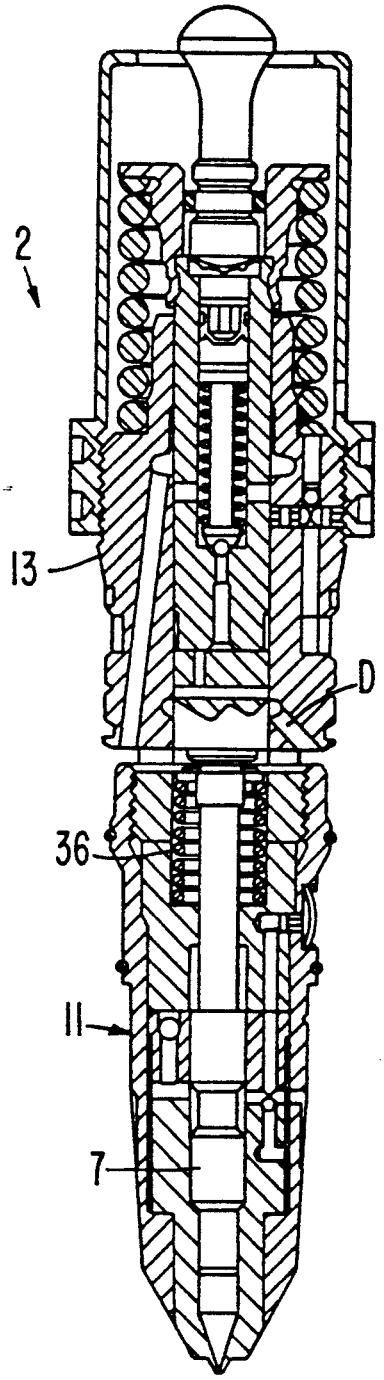
FIG. 2 is a cross-sectional view of an open nozzle fuel injector in accordance with a first embodiment of the invention.

FIG. 1 illustrates a closed nozzle injector 1, and FIG. 2 shows an open nozzle injector 2. Thus, these two figures represent injectors having different injection characteristics. As such, prior to U.S. Pat. No. 5,209,403, either type of fuel injector had been specially design to function only in the manner of the particular type of injector desired, i.e., to function only on the basis of either open or closed nozzle injector concepts. However, because of the development of said parent application, the injectors 1 and 2 are able to share a common nucleus of components in a way which provides a unit fuel injector system which can be operated as either a closed nozzle type fuel injector 1 or as an open nozzle type fuel injector 2 without altering the timing or metering principles, by selecting between a closed nozzle type injector nozzle subassembly 10 (FIG. 4) and an open nozzle type injector nozzle subassembly 11 (FIG. 5). That is, so long as the size and stroke of the metering and injection plungers and their return springs were appropriately coordinated, the common, upper control subassembly 13 (FIG. 3) can control metering and injection irrespective of whether the nozzle assembly operates on open nozzle or closed nozzle principles.

In particular, it was determined that the control portion forming the upper half of the high pressure fuel injector having a timing chamber pressure control valve as is described in the parent application, could serve as the common control subassembly 13. Such a control subassembly is comprised of a main return spring housing or top stop 17 which is mounted on an upper barrel part 19, a main return spring 21 that is held between barrel 5 and an injector coupling 23, which is carried by an upper plunger 25 and has an injector link 24 (which forms part of an unillustrated, conventional cam-driven injector drive train) loosely secured therein. The control subassembly 13 also includes an intermediate, timing plunger 27 and a ball valve type timing chamber relief valve assembly 29. Since the details of the operation of the open nozzle injector 2 are identical to that disclosed in the parent application, reference can be made to that application for such details, it being hereby incorporated by reference for that purpose. However, preferred manners of implementing the timing chamber relief valve assembly 29, including modified forms thereof, for achieving the object of enabling the opening stroke thereof to be adjusted independently of the spring load on its valve element without leading to either chattering of the valve element or excessive injection pressure droop, are described below in connection with FIGS. 11–15.

Additionally, in accordance with this invention, the subassemblies 10, 11 have been given a common external envelope to allow either to be installed in the same engine without modification. Achieving of a common external envelope meant accepting an open nozzle injector that was somewhat larger/longer than it could otherwise be, and a closed nozzle design that was somewhat more complex in terms of the modified drillings required to match the port locations of the closed nozzle injector to those of the open nozzle version.

The lower half of the fuel injector of the above-referenced patent application has been adopted as the open nozzle type nozzle subassembly 11. This subassembly 11 comprises a lower body part 30 that is disposed on an injector cup 32 within a nozzle retainer 34 (which secures the lower body part 30 and the injector cup 32 to injector barrel 19), in addition to the previously mentioned metering and injection plunger 7. Here again, reference can be made to U.S. Pat. No. 5,209,403 for a more detailed description thereof.

The nozzle subassembly 10 of FIG. 4 operates on the principles described relative to the closed nozzle fuel injectors of the above-noted U.S. Pat. No. 4,463,901, but having been constructionally modified to insure that the ports and passages through which fuel flows into and out of the nozzle subassembly 10 are coordinated to those of the open nozzle nozzle subassembly 11 and to insure that the injection and meeting plunger is sized to execute the proper stroke as well as to meter and inject the correct quantity of fuel at the proper pressure under the action of the control subassembly 13. In this regard, it is noted that the same return spring 36 is used, here, for both the open and closed nozzle versions, and for this reason, return spring 36 is shown with the control subassembly 13 and not around the plungers 6, 7 of the subassemblies 10, 11, as appears, in FIGS. 1 & 2, for the injectors 1 and 2. This common use of return spring 36 is desirable because it acts directly on the timing plunger 27 in the closed nozzle injector 1 and indirectly on this plunger via the lower, injection and metering plunger 7 in the open nozzle injector 2, thus, in either version the same pressure will act on timing plunger 27, so that no corrective adjustments of the control subassembly 13 need to be made; although, such would be an alternative. Furthermore, the same spring can be used for both nozzle subassemblies since the return spring 36 does not act on the injection and metering plunger 6 of the close nozzle nozzle assembly (enabling metering to be performed independent of the position of the timing plunger 27), a separate spring S being disposed within a sleeve located concentrically between return spring 36 and the plunger 6 so as to act between the top end of the sleeve and a shoulder formed on the injection and metering plunger 6.

The closed nozzle nozzle subassembly 10 is comprised of a lower body part 40 (in which fuel infeed and drain passages **40*a*, 40*b* as well as a variable volume metering and injection chamber 40*c* are formed), a fuel distribution plate 42, a valve spring housing 44, and an injector cup 46 which are stacked one upon the other within retainer 48, in addition to the nozzle valve assembly 5, and the metering and injection plunger 6. Like retainer 34, retainer 48 connects the nozzle subassembly 10 to the control subassembly 13, to form the injector 1 which, then, is able to operate on the same timing and metering principles as the above-mentioned known closed nozzle unit fuel injector, under the control of the control subassembly 13, even though the control subassembly functions in the same manner as it does when part of the open nozzle unit fuel injector 2** (although, it would be driven by a different cam when used as a closed nozzle fuel injector than when it is used in an open nozzle fuel injector, as is normally the case).

Figure 6:
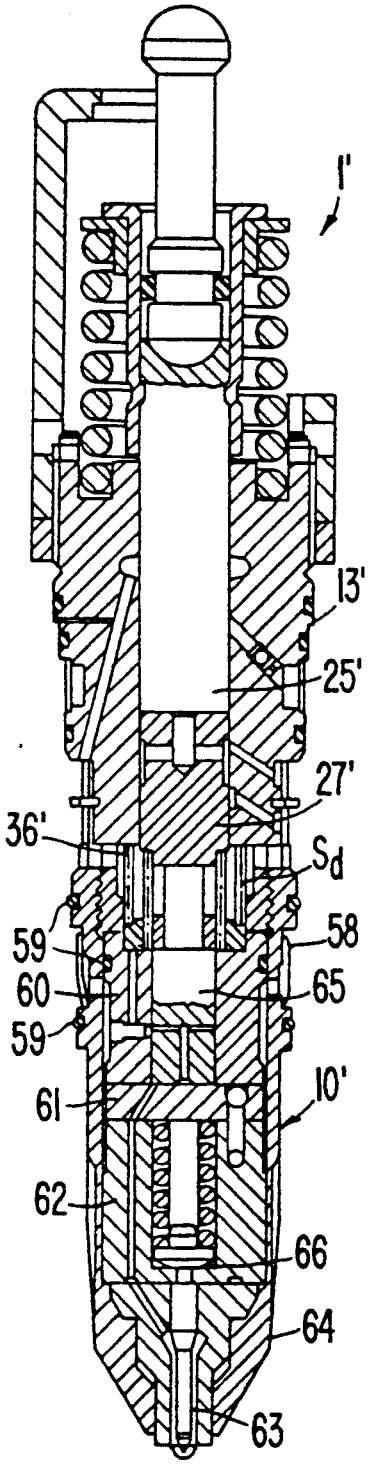
FIG. 6 is a cross-sectional view of a second closed nozzle fuel injector in accordance with the present invention.
Figure 7:
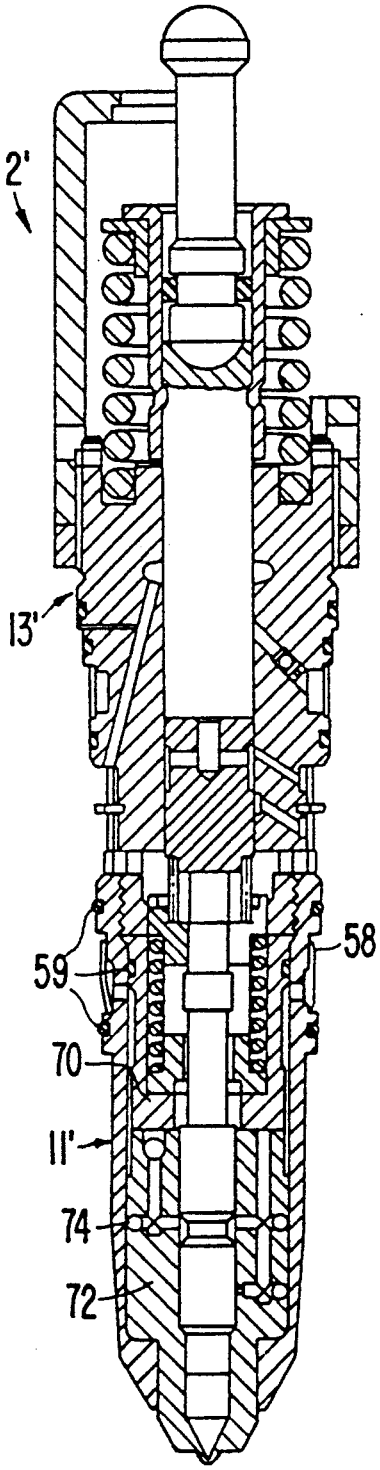
FIG. 7 is a cross-sectional view of a second open nozzle fuel injector in accordance with the present invention.
Figure 8:
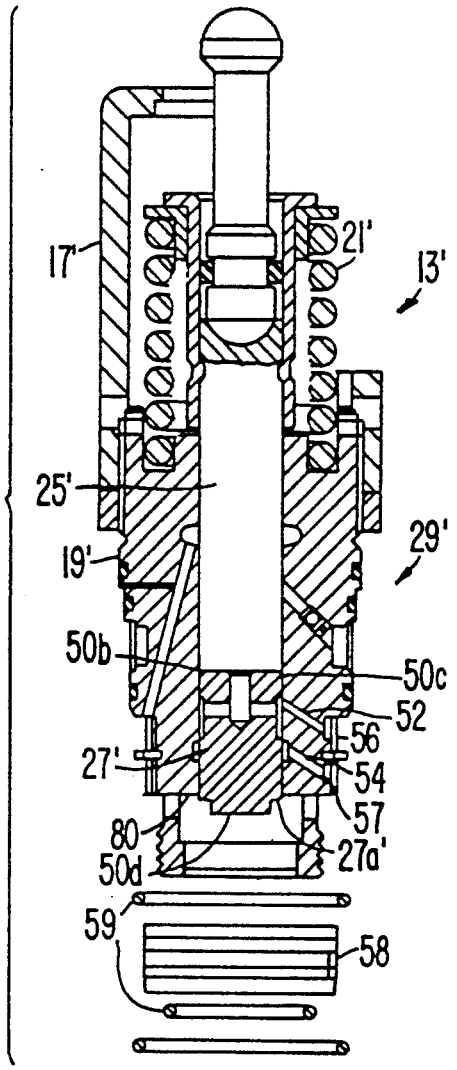
FIG. 8 is a cross-sectional view of a second control subassembly for use with the fuel injector in accordance with both of FIGS. 6 and 7.
Figure 9:
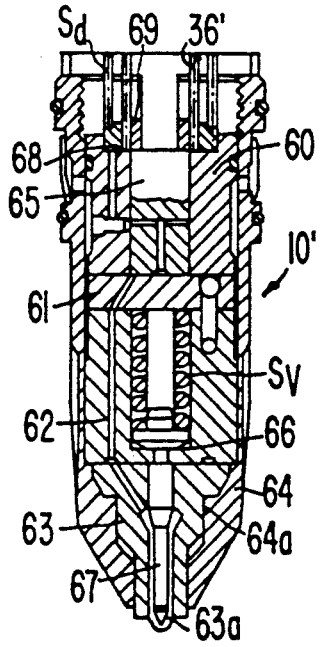
FIG. 9 is a cross-sectional view of a second nozzle subassembly of the closed nozzle type for use with the control subassembly of FIG. 8 in the fuel injector of FIG. 6.
Figure 10:
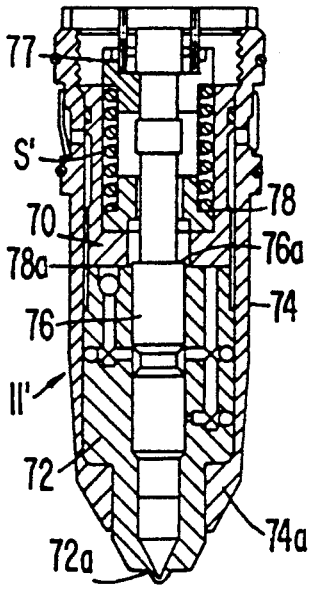
FIG. 10 is a cross-sectional view of a second nozzle subassembly of the open nozzle type for use with the control subassembly of FIG. 8 in the fuel injector of FIG. 7.

While the fuel injector system described above demonstrated that a fuel injector could be advantageously constructed to use interchangeable subassemblies to allow the fuel injector to be converted from open to closed nozzle options without affecting engine installation, and without altering the timing or metering principles, as also indicated, compromises from an optimized designed had to be accepted to do so. Thus, it, then, needed to be determined what would be the result if the "commonized" design concept were included as a design factor in the development of new open nozzle and closed nozzle fuel injectors. FIGS. 6 & 7 depict the resultant closed nozzle unit fuel injector 1' and open nozzle unit fuel injector 2' that were developed, and FIGS. 8–10 show the control subassembly 13' and nozzle subassemblies 10', 11' of which they are comprised.

Considering the control subassembly 13', first, like the control subassembly 13, it is comprised of a main return spring housing or top stop 17' which is mounted on an upper barrel part 19', a main return spring 21' that is held between barrel 5' and an injector coupling 23', which is carried by an upper plunger 25' and has an injector link 24' (which forms part of an unillustrated, conventional cam-driven injector drive train) loosely secured therein, as well as an intermediate, timing plunger 27' that is located below the upper plunger 25' and which defines a variable volume timing chamber between its upper surface and the bottom face of the upper plunger 25'. The control subassembly 13' also includes a timing chamber relief valve assembly 29' which is located wholly within the control subassembly 13'. Timing chamber relief valve assembly 29' comprises a plunger drain path, formed in the timing plunger 27' by an axial passage **50*a* which communicates with a plurality of radial bores 50*b* and 50*c* which open into annular groove 50*d*, and in the upper barrel part 19' by at least one valved passage 52 or at least one valve passage 54 (depending on the location of the timing plunger) which connect this groove 50*d*, in turn, with the drain rail of the engine head (not shown) via respective band-like high pressure limiting valves 56 and 57 that are mounted on the outside of injector upper barrel part 19'. The relief valve assembly 29' constitutes a pressure actuated valve means for commencing and blocking a flow of timing fluid through the plunger drain path and the at least one passage 52, or 54 in dependence upon whether the pressure of the timing fluid exceeds or is below a predetermined value set by the band-like valve spring. In the illustrated embodiment, the upper barrel part 19' serves as a valve body having a circumferential wall with at least one surface area in which the outlet port of the at least one passage 52 or 54** is formed, and over which the band-like resilient valve spring member is mounted so as to seal the at least one port in a closed condition thereof and so as to resiliently move into a second, open condition, in which said band-like spring member is displaced from said circumferential wall for permitting discharge of timing fluid from the at least one port, under pressure exerted by the timing fluid in the at least one port.

Since the further details of the nature and operation of the timing chamber relief valve assembly 29' are identical to that disclosed in commonly owned, co-pending U.S. patent application Ser. No. 07/898,818, reference can be made to that patent application for such details, it being hereby incorporated by reference for that purpose.

However, it is noted that the limiting valves 56, 57, comprise a continuous or split valve spring member mounted over the outside of injector upper barrel part 19' in a way that permits the preloading of the spring member to be concentrated in the area of one or more outlet ports to be closed thereby, such that high pressures can be regulated with precision. Also, while the spring member is shown mounted on an outer surface of an injector upper barrel part 19', mounting of the valve spring member on the timing plunger, as described in the reference Ser. No. 07/898,818, is also possible without affecting the ability of the control subassembly to interchangeably act with open and closed nozzle type injector nozzle subassemblies in accordance with this invention. Furthermore, the limiting valves 56, 57 may take the form of any of the various valve embodiments of that application as well.

While not part of the control subassembly 13', the fuel screening element 58 and the O-ring seals 59 are shown with it to reflect the fact that these parts of the nozzle subassemblies 10' and 11' are shared parts that are common to both types of nozzle subassemblies. The locations of the screening element 58 and seals 59 can be seen in FIGS. 6 and 7 on both injectors 1' and 2'.

FIG. 9 illustrates a closed nozzle type injector nozzle subassembly 10' for forming the closed nozzle unit fuel injector shown in FIG. 6. Subassembly 10' comprises a lower injector body part 60, a fuel distributing plunger seat disc 61, a spring housing block 62, an injector cup 63 having an injection nozzle **63*a* with spray orifices for spraying fuel into the combustion chamber (not shown) of an internal combustion engine, and a retainer 64 having a shoulder 64*a* for capturing the injector cup 63. The retainer 64 receives the injector cup 63, supported on shoulder 64*a* with spray nozzle 63*a* projecting from the bottom end thereof. The lower body part 60 is received in the retainer 64 supported on the plunger seat disc 61 which is stacked on the spring housing block 62 and injector cup 63. Furthermore, retainer 64 secures the received parts together in end-to-end fashion with the upper barrel part 19'. For this purpose, the top end of the retainer 64 has internal threads by which it is connected to external threads on the bottom end of upper injector upper barrel part 19', as shown in FIG. 6. A reciprocating lower, metering and injection plunger 65 is received in a bore extending through lower body part 60 and a variable volume metering and injection chamber is formed between the bottom end of the metering and injection plunger 65 and the facing surface of the plunger seat disc 61. The flow of fuel through the orifices of nozzle 63*a* of injector cup 63 is controlled by a pressure responsive valve assembly 66 which includes a valve pin 67 which is acted upon by a valve spring $S_v$ in a conventional manner. At the end of the injection event, fuel remaining in the metering and injection chamber is returned to the engine drain path when it is pressurized to a level which opens a drain valve 68 by overcoming the force of a drain valve spring $S_d$ that acts between the drain valve 68 and a shoulder 80 formed on an inside surface of the upper barrel part 19'. A plunger return spring 36' acts between the lower metering and injection plunger 65 and the timing plunger 27' of the control subassembly 13' to return them to the position shown in FIG. 6 at the end of each injection cycle. For this purpose, the lower end of spring 36' engages a spring keeper 69, that is supported on a shoulder of plunger 65, and the upper end of the spring 36' engages a shoulder 27'*a* on the bottom end of timing plunger 27'**.

Inasmuch as the injector 1' with the nozzle subassembly 10' is constructed in a manner fully conforming with the disclosure of commonly assigned, co-pending U.S. patent application Ser. No. 08/096,935 filed Jul. 26, 1993 entitled "HIGH PRESSURE FUEL INJECTOR WITH FUEL DRAINAGE VALVE" (except for the use of a separate drain valve 68 and drain spring $S_d$, here, instead of having the spring keeper serve this function as in this noted application), further details of the other aspects of the construction and operation of this closed nozzle type injector 1' can be had by reference to said application, which is hereby incorporated by reference for that purpose.

The nozzle subassembly 11' of the open nozzle type comprises a lower injector body part 70, an injector cup 72 having an injection nozzle 73 with spray orifices for spraying fuel into the combustion chamber (not shown) of an internal combustion engine, and a retainer 74 having a shoulder **74*a* for capturing the injector cup 72. The retainer 74 receives the injector cup 72, supported on shoulder 74*a* with spray nozzle 72*a* projecting from the bottom end thereof. The lower body part 70 is received in the retainer 74 supported on the injector cup 72. Furthermore, retainer 74 secures the injector cup 72 and lower body part 70 together in end-to-end fashion with the upper barrel part 19' of control subassembly 13'. For this purpose, the top end of the retainer 74 has internal threads by which it is connected to external threads on the bottom end of upper injector barrel part 19', as shown in FIG. 7. A lower, metering and injection plunger 76 is disposed so as to reciprocate in a central bore of the injector cup 72 and extends upwardly through the lower injector body part. A variable volume metering and injection chamber is formed below the metering and injection plunger 76 in the central bore of the injector cup 72. The metering and injection plunger 76 is returned from the bottom end position shown in the drawings by a return spring S' that is captured between an upper spring keeper 77 and a lower spring keeper 78**.

When the metering and injection plunger 76 is moved upwardly by spring S', acting through upper keeper 77, shoulder 80 of upper barrel part 19' serves as a stop surface that limits the upward movement of the upper spring keeper 77 that can be produced by the spring S'. Once upper keeper 77 engages the stop surface formed by shoulder 80, the considerable momentum of the lower metering and injection plunger 76 causes it to continue freely upward through spring keepers 77, 78 until land 76*a* engages in counterbore 78*a* of the lower spring keeper 78. At this point, the momentum of lower, metering and injection plunger 76 is transferred to spring S' via lower keeper 78.

In this way, a cushioned stopping of the metering and injection plunger 76 is produced which reduces wear and noise relative to that which would be the case if a rigid connection existed between the upper spring keeper 77 and the lower, metering and injection plunger 76 (in which case the upper spring keeper would have to absorb all of the momentum of this rigid metal component). At the same time, the stroke of metering and injection plunger 76 is limited to an amount which is just sufficient to produce an injection chamber that has a maximum volume which essentially equals that of the maximum dosage of fuel that it will be necessary for the injector to inject. In this way, detonation of the fuel within the injector can be avoided. That is, if the lower, metering and injection plunger 76 followed the full, for example, one inch stroke of the upper plunger 25', a considerable vacuum would be created under it and plunger 76 would draw in a lot of air from the combustion chamber of the engine. This air would be greatly compressed during the downstroke and could lead to detonation of the fuel within the injection chamber, especially since this air would, itself, become fuel laden. In contrast, by limiting the upward movement of the metering and injection plunger 76 to, for example, half that of the upper plunger 25' (e.g., one-half inch vs. one inch), both the amount of air and the degree to which it is compressed and heated can be reduced to such an extent that fuel detonation can be avoided.

Inasmuch as the injector 2' with the nozzle subassembly 11' is constructed in a manner fully conforming with the disclosure of commonly assigned, co-pending U.S. patent application Ser. No. 07/945,390, filed Sep. 16, 1992, entitled "HIGH PRESSURE FUEL INJECTOR WITH CUSHIONED PLUNGER STOP" and the further details of this cushioned stop feature and other aspects of the construction and operation of this open nozzle type injector 2' can be had by reference to said application, which is hereby incorporated by reference for that purpose. Additionally, while one form of cushioned stop has been shown and described herein, it should be appreciated that any of the forms in which such is embodied in this application could be utilized in a nozzle subassembly 11' in accordance with the present invention.

It should be appreciated that while only one specific form of closed and open type nozzle subassembly 10, 10' and 11, 11' has been described for use with each of the control subassemblies 13, 13', a plurality of different types of open nozzle and/or closed nozzle type nozzle subassemblies could be interchangeably usable with any given control assembly to allow adaption of the system to a variety of different types of engines and engine operating conditions, and the same is true with respect to subassemblies of the same type that have been designed to inject different fuel dose amounts or to have differing port placements, etc.

In this regard, it is contemplated that , in certain circumstances, it may be preferable to utilize a control assembly 13 with either of nozzle subassemblies 11', 13'. However, as mentioned in the Background portion of this application, the design of the timing chamber relief valve assembly 29 of control assembly 13, as described above and as disclosed in U.S. Pat. No. 5,209,403, does not take into consideration the fact that insufficient spring pressure can lead to chattering of the valve element while high valve spring loading of the valve element can lead to excessive "droop" values (i.e., the difference between the injection pressures produced by the relief valve under low speed engine operating conditions and the injection pressures produced by the relief valve under high speed engine operating conditions) that can result in injection pressures that are either excessive at high engine speeds or insufficient at low engine speeds. With these factors in mind, an upper plunger 25" having preferred forms for a modified relief valve assembly 29" will now be described relative to FIGS. 11–15.

Figure 3:
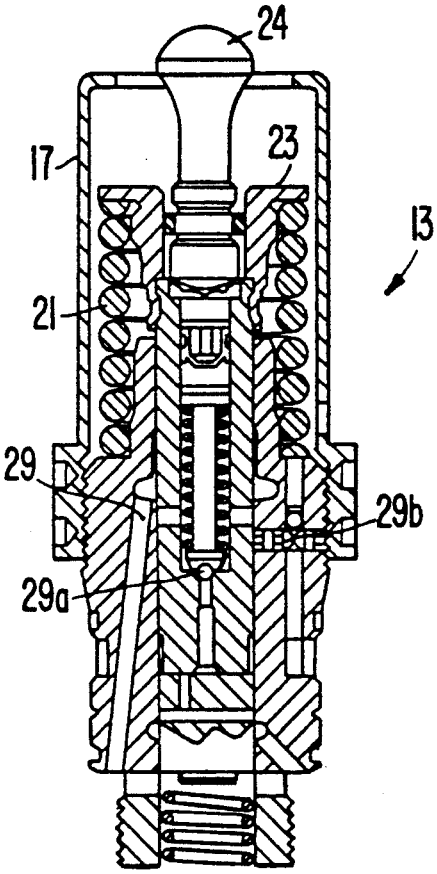
FIG. 3 is a cross-sectional view of a control subassembly of the fuel injector in accordance with both of FIGS. 1 and 2.
Figure 13:
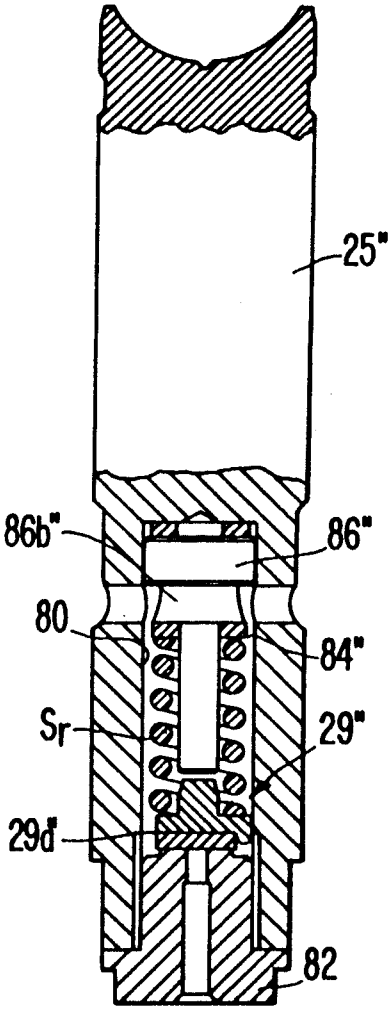
FIGS. 11–13 show three modified forms of a timing chamber relief valve assembly.
Figure 12:
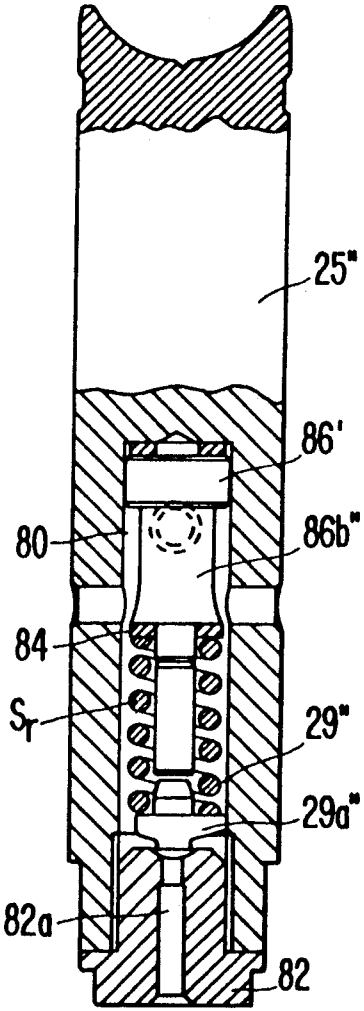
Figure 11:
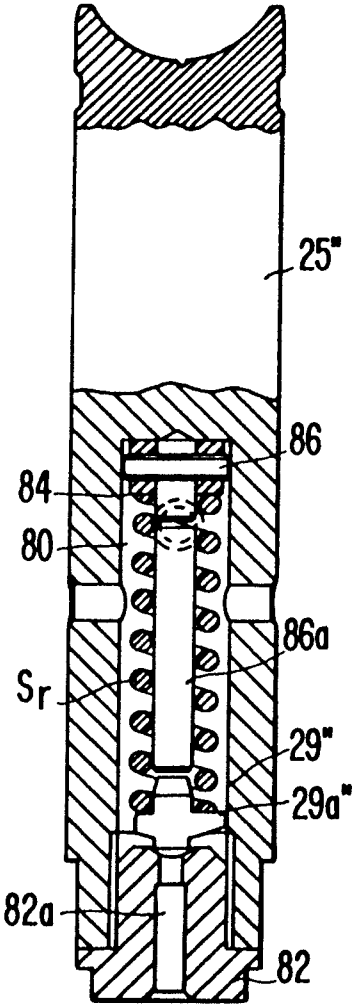

Referring, first, to FIGS. 11–13, the upper plunger 25" thereof differs from the upper plunger 25 of FIGS. 1–3 (and FIG. 3 of the parent application) in that a central recess 80 is provided for receiving the valve assembly 29" which is formed into the bottom end thereof and is closed by a valve seat element 82 that is threaded therein and which contains a timing fluid drain passage 82*a*; this is in contrast to plunger 25 which has a central bore that is closed at its top end by a base stop, and which has the valve seat for a ball valve element 29*a* and the timing fluid drain passage 25*a* directly formed into the lower end of the plunger itself.

As for the valve assembly 29", instead of a two-piece, ball element valve 29*a* and ball-seat valve element 29*b*, a one-piece valve element 29"*a* is utilized that may have a spheric (FIG. 11), conic (FIG. 12) or planar (FIG. 13) projection for engaging the valve seat of valve seat element 82 to seal the inner end of drain passage 82*a* under the action of a relief valve spring $S_r$. The force applied by spring $S_r$ to valve element 29" can be adjusted by one or more shims 84, and the degree to which the valve element is permitted to open is set by the selection of a valve stop 86 having a valve stop projection 86*a* of appropriate length (if the travel is too limited, insufficient flow from the timing chamber will result while to long a valve stroke contributes to chattering of the valve element 29"*a*; a 0.009" stroke has been found to insure sufficient flow without chattering). Alternatively, or in addition to the use of shims 84 to adjust the spring force, a valve stop element 86' or 86" can be provided with an integral shim 86'*a* or 86"*a* (FIGS. 12, 13) to increase the spring force.

The spring force is important from two standpoints. Firstly, it sets the threshold value at which valve 29" opens to drain timing fluid, and thus, set the limiting value of the injection pressure. Secondly, the spring force, together with the moving mass (i.e., the mass of the valve element 29"*a* and the portion of the spring which moves with it), determines the natural frequency of the valve 29", thereby setting the point at which vibration of the valve will lead to chattering of the valve element 29"*a* against the valve seat element 82. In this respect, the combination of spring force and moving mass should be selected to yield a natural frequency above approximately 7,000 Hz to prevent valve 29"*a* from chattering; the natural frequency has been found to increase with increases in spring force and decreases in the moving mass of the valve element 29"*a* and spring $S_r$. For example, a sufficiently high natural frequency can be obtained with a spring having a spring rate of 350 lbs.F/in. and a valve element 29"*a* formed of tool steel (producing a moving mass of 0.002514 lbs.), while the same valve element can be used with a spring having a spring rate of only 285 lbs.F/in. if the valve element is made of a lighter ceramic material (producing a moving mass of only 0.002037 lbs., in comparison); in contrast, a heavier valve element was found to chatter with a spring having a spring rate of 343 lbs.F/in. since the natural frequency was reduced to just under 6300 Hz as a result of a moving mass of 0.00336 lbs.

The use of as low a spring rate as possible (which means using as light a valve element as possible) is desired to minimize the above-mentioned "droop" problem, not from a valve chattering standpoint. That is, as can be seen with reference to FIG. 15, as the spring rate of spring $S_r$ increases, the curve of injection pressure vs. engine speed approaches that of the base line situation in which no timing fluid relief valve is provided and the pressure difference between the injection pressure at low speeds vs. those at high engine speeds is at it maximum. In order to insure that sufficient pressure is obtained during low speed operation without excessive pressures occurring during high speed operation, the present inventors have found that a pressure droop between 1,400 and 2,500 rpm engine speeds should be no more than about 8,000 psi. From this standpoint, it can be seen from FIG. 15 that, even though a spring rate of 650 lbs.F/in. will result in the natural frequency being high enough to avoid chattering, a high spring rate increases the pressure droop, and in the case of the 650 spring, produces a pressure droop of over 12,000 psi between 1,400 and 2,500 psi. As a result, if sufficiently high pressure is to be obtained at low engine operating speeds (e.g., about 18–20 kpsi at 1,400 rpm), then injection pressures will occur in the high speed operating range that will be so high (over 30,000 psi) that the ability of the injector to withstand them will be exceeded. Thus, both the tool steel valve with the 350 spring and the ceramic valve with the 285 spring exhibit sufficiently low droop values in FIG. 15, and as noted above, both lead to valve assemblies having sufficiently high natural frequencies to avoid valve chattering.

In operation, valve assembly 29" is closed at the beginning of the injection event; but, when the injection pressure, which is mirrored in the pressure of the timing fluid in the timing chamber, exceeds a predetermined maximum pressure, the timing fluid in the timing chamber, which acts on the underside of the valve element, overcomes the spring loading of spring $S_r$ and cause the timing fluid drain passage 82*a* to open in a controlled manner. Timing fluid then flows out of the timing chamber, through passage 82*a*, around valve element 29"*a*, up and out of the recess 80 via the drain ports 88, and then into drain passage D (FIGS. 1–3) leading to the engine drain path in otherwise conventional fashion. As a result, the timing chamber, which serves as a hydraulic link between the upper plunger 25" and the timing plunger 27, collapses, thereby absorbing downward movement of the upper plunger 25" and limiting the force being applied to the fuel in the injection chamber by the plunger assembly.

Figure 14:
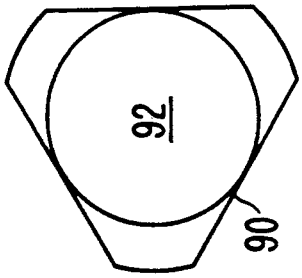
FIG. 14 is a top plan view of a valve element of the valve assemblies of FIGS. 11–13.
Figure 15:
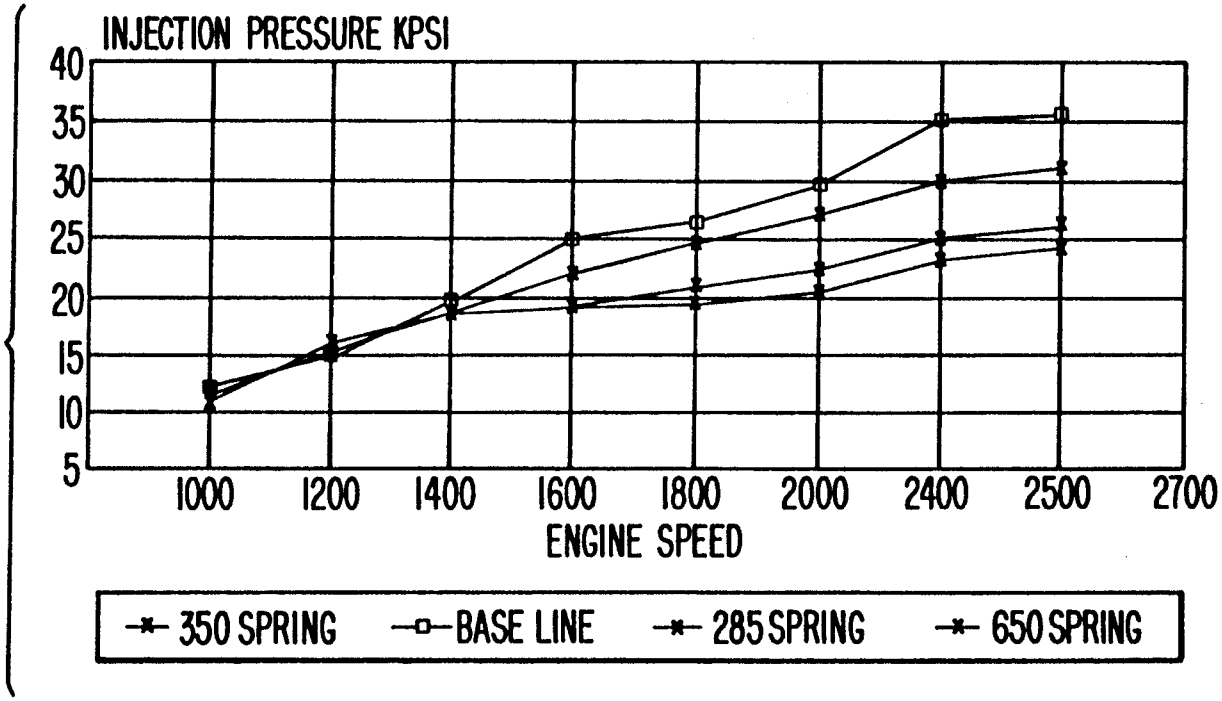
FIG. 15 is a graph showing the relationship between injection pressure and engine speed for the valve assemblies of FIGS. 11–13 with springs of differing spring rates in comparison to the injector without pressure relief of the fluid in the timing chamber.

As can be seen from FIG. 14, timing fluid is able to flow around the valve element 29"*a* by making it somewhat triangular when view from above and below. This shape provides flanges 90 for supporting the bottom of spring $S_r$ and a centering projection 92, while the flat sides create a flow path between the valve element 29"*a* and the inner wall of the upper plunger within recess 80.

INDUSTRIAL APPLICABILITY

The present invention will find applicability in a wide range of fuel injection systems for internal combustion engines, particularly diesel engines. The invention will be especially useful where it is desired to have a single fuel injection system that is able to be easily and inexpensively adapted to meet the requirements of a wide range of different engines and engine use conditions.

We claim:

1. A unit fuel injector for an internal combustion engine having an injector body with injection orifices at a lower end thereof, an upper plunger, a timing plunger and a lower plunger which are mounted for reciprocation within the injector body; wherein the injector is divided into two subassemblies, an upper control subassembly and a lower nozzle subassembly; wherein the upper control subassembly comprises an upper portion of the injector body, and the upper and timing plungers; and wherein a plurality of different nozzle subassemblies are provided which are interchangeably mountable to a lower end of the control subassembly; wherein at least one of said nozzle subassemblies is an open nozzle type nozzle subassembly that comprises a lower portion of the injector body which has said injection orifices and a bore extending therethrough to the injection orifices, and a said lower plunger mounted in said bore; and wherein at least one of said nozzle subassemblies is a closed nozzle type nozzle subassembly that comprises a lower portion of the injector body which has said injection orifices and a metering and injection chamber therein, a said lower plunger mounted for reciprocation in the injection chamber, and a pressure responsive valve for controlling fuel flow from the metering and injection chamber to the injection orifices.

2. A unit fuel injector according to claim 1, wherein all of the nozzle subassemblies have the same external size and configuration so that the fuel injector has the same external size and configuration irrespective of which nozzle subassembly is attached to the control subassembly, whereby the fuel injector can be converted from one including one type of nozzle subassembly to another without affecting installation of the fuel injector in an engine.

3. A unit fuel injector according to claim 1, wherein all of the nozzle subassemblies are configured such that they utilize the same metering control principles, whereby the fuel injector can be converted from one including one type of nozzle subassembly to another without requiring modification of the control subassembly.

4. A unit fuel injector according to claim 3, wherein said control subassembly further comprises a pressure actuated valve means for commencing and blocking a flow of timing fluid from a variable volume timing fluid chamber, defined between the upper plunger and the timing plunger, through passage means in the timing plunger and at least one flow passage formed in the upper portion of the injector body in dependence upon whether the pressure of said timing fluid is at least a predetermined value; wherein said pressure actuated valve means includes a valve body having a circumferential wall with at least one surface area in which at least one outlet port is formed, and a band-shaped resilient valve spring member mounted over the circumferential wall of the valve body; wherein said spring member seals said at least one port in a closed condition thereof; and wherein said spring member is resiliently movable into a second, open condition, in which said band-shaped spring member is displaced from said circumferential wall for permitting discharge of fluid from said at least one port, under pressure exerted by fluid in said at least one port.

5. A unit fuel injector according to claim 1, wherein said control subassembly further comprises a pressure actuated valve means for commencing and blocking a flow of timing fluid from a variable volume timing fluid chamber, defined between the upper plunger and the timing plunger, through passage means in the timing plunger and at least one flow passage formed in the upper portion of the injector body in dependence upon whether the pressure of said timing fluid is at least a predetermined value; wherein said pressure actuated valve means includes a valve body having a circumferential wall with at least one surface area in which at least one outlet port is formed, and a band-shaped resilient valve spring member mounted over the circumferential wall of the valve body; wherein said spring member seals said at least one port in a closed condition thereof; and wherein said spring member is resiliently movable into a second, open condition, in which said band-shaped spring member is displaced from said circumferential wall for permitting discharge of fluid from said at least one port, under pressure exerted by fluid in said at least one port.

6. A unit fuel injector according to claim 5, wherein the open nozzle type nozzle subassembly further comprises cushioning means for limiting return travel of the lower plunger, at an end of each injection cycle, to less than that of said upper plunger in an impact absorbing manner.

7. A unit fuel injector according to claim 5, wherein a drain passage is formed in the lower portion of the injector body of the closed nozzle type nozzle subassembly for providing a drainage path from said metering and injection chamber; wherein a pressure-responsive valve means is provided for closing said drain passage when the pressure of fuel in the metering and injection chamber is below a predetermined value; and wherein the pressure-responsive valve means comprises an annular spring keeper disposed about an upper portion of the lower plunger in overlying relationship to an outlet end of the drain passage formed in an inner surface of the lower portion of the injector body, and a spring acting between said spring keeper and a shoulder formed on an inner surface of the upper portion of the injector body of the control subassembly.

8. A unit fuel injector according to claim 1, wherein the open nozzle subassembly type nozzle further comprises cushioning means for limiting return travel of the lower plunger, at an end of each injection cycle, to less than that of said upper plunger in an impact absorbing manner.

9. A unit fuel injector according to claim 1, wherein a drain passage is formed in the lower portion of the injector body of the closed nozzle type nozzle subassembly for providing a drainage path from said metering and injection chamber; wherein a pressure-responsive valve means is provided for closing said drain passage when the pressure of fuel in the metering and injection chamber is below a predetermined value; and wherein the pressure-responsive valve means comprises an annular spring keeper disposed about an upper portion of the lower plunger in overlying relationship to an outlet end of the drain passage formed in an inner surface of the lower portion of the injector body, and a spring acting between said spring keeper and a shoulder formed on an inner surface of the upper portion of the injector body of the control subassembly.

10. A fuel injector for an internal combustion engine having an injector body having injection orifices at a lower end thereof, an upper plunger and a lower plunger which are mounted for reciprocation within the injector body; wherein the injector is divided into two subassemblies, an upper control subassembly and a lower nozzle subassembly; wherein the upper control subassembly comprises an upper portion of the injector body and the upper plunger; and wherein a plurality of different types of nozzle subassemblies are provided which are interchangeably mountable to a lower end of the upper subassembly; and wherein each of said nozzle subassemblies comprises a lower portion of the injector body which has said injection orifices and a metering and injection chamber into which fuel to be injected is metered, and a said lower plunger for injecting fuel metered into said chamber through the injection orifices.

11. A unit fuel injector according to claim 10, wherein all of the nozzle subassemblies have the same external size and configuration so that the fuel injector has the same external size and configuration irrespective of which nozzle assembly is attached to the control subassembly, whereby the fuel injector can be converted from one type of nozzle subassembly to another without affecting installation of the fuel injector in an engine.

12. A unit fuel injector according to claim 10, wherein all of the nozzle subassemblies are configures such that they utilize the same metering control principles, whereby the fuel injector can be converted from one including one type of nozzle subassembly to another without requiring modification of the control subassembly.

13. A unit fuel injector according to claim 12, wherein said control subassembly further comprises a timing plunger located between said upper and lower plungers, a pressure actuated valve means for commencing and blocking a flow of timing fluid from a variable volume timing fluid chamber, defined between the upper plunger and the timing plunger, through passage means in the timing plunger and at least one flow passage formed in the upper portion of the injector body in dependence upon whether the pressure of said timing fluid is at least a predetermined value; wherein said pressure actuated valve means includes a valve body having a circumferential wall with at least one surface area in which at least one outlet port is formed, and a band shaped resilient valve spring member mounted over the circumferential wall of the valve body; wherein said spring member seals said at least one port in a closed condition thereof; and wherein said spring member is resiliently movable into a second, open condition, in which said band-shaped spring member is displaced from said circumferential wall for permitting discharge of fluid from said at least one port, under pressure exerted by fluid in said at least one port.

14. A unit fuel injector according to claim 13, wherein the different types of nozzle subassemblies include an open nozzle type nozzle subassembly, and the open nozzle type nozzle subassembly further comprises cushioning means for limiting return travel of the lower plunger, at an end of each injection cycle, to less than that of said upper plunger in an impact absorbing manner.

15. A unit fuel injector according to claim 13, wherein the different types of nozzle subassemblies include a closed nozzle type nozzle subassembly, and a drain passage is formed in the lower portion of the injector body of the closed nozzle type nozzle subassembly for providing a drainage path from said metering and injection chamber; wherein a pressure-responsive valve means is provided for closing said drain passage when the pressure of fuel in the metering and injection chamber is below a predetermined value; and wherein the pressure-responsive valve means comprises an annular spring keeper disposed about an upper portion of the lower plunger in overlying relationship to an outlet end of the drain passage formed in an inner surface of the lower portion of the injector body, and a spring acting between said spring keeper and a shoulder formed on an inner surface of the upper portion of the injector body of the control subassembly.

16. A unit fuel injector according to claim 10, wherein said control subassembly further comprises a timing plunger located between said upper and lower plungers, a pressure actuated valve means for commencing and blocking a flow of timing fluid from a variable volume timing fluid chamber, defined between the upper plunger and the timing plunger, through passage means in the timing plunger and at least one flow passage formed in the upper portion of the injector body in dependence upon whether the pressure of said timing fluid is at least a predetermined value; wherein said pressure actuated valve means includes a valve body having a circumferential wall with at least one surface area in which at least one outlet port is formed, and a band-shaped resilient valve spring member mounted over the circumferential wall of the valve body; wherein said spring member seals said at least one port in a closed condition thereof; and wherein said spring member is resiliently movable into a second, open condition, in which said band-shaped spring member is displaced from said circumferential wall for permitting discharge of fluid from said at least one port, under pressure exerted by fluid in said at least one port.

17. A unit fuel injector according to claim 10, wherein the different types of nozzle subassemblies include an open nozzle type nozzle subassembly, and the open nozzle type nozzle subassembly further comprises cushioning means for limiting return travel of the lower plunger, at an end of each injection cycle, to less than that of said upper plunger in an impact absorbing manner.

18. A unit fuel injector according to claim 10, wherein the different types of nozzle subassemblies include a closed nozzle type nozzle subassembly, and a drain passage is formed in the lower portion of the injector body of the closed nozzle type nozzle subassembly for providing a drainage path from said metering and injection chamber; wherein a pressure-responsive valve means is provided for closing said drain passage when the pressure of fuel in the metering and injection chamber is below a predetermined value; and wherein the pressure-responsive valve means comprises an annular spring keeper disposed about an upper portion of the lower plunger in overlying relationship to an outlet end of the drain passage formed in an inner surface of the lower portion of the injector body, and a spring acting between said spring keeper and a shoulder formed on an inner surface of the upper portion of the injector body of the control subassembly.

19. A unit fuel injector according to claim 10, wherein said control subassembly further comprises a timing plunger located between said upper and lower plungers, a pressure actuated valve means for commencing and blocking a flow of timing fluid from a variable volume timing fluid chamber, defined between the upper plunger and the timing plunger, through passage means in the timing plunger and at least one flow passage formed in the upper portion of the injector body in dependence upon whether the pressure of said timing fluid is at least a predetermined value; wherein said pressure actuated valve means is located within said upper plunger and includes a valve element, spring means for biasing the valve element against a valve seat formed in said upper plunger, stop means carried by said spring means for limiting a valve opening movement of said valve element; and wherein said spring means has a spring rate which coacts with a moving mass of said valve element and spring means to form a performance means for achieving a natural frequency of the valve element that is high enough to prevent chattering of the valve element and a valve droop value which insures sufficient injection pressures under low speed engine operating conditions while avoiding excessive injection pressures under high speed engine operating conditions.

* * * * *